United States Patent [19]

Orndorff et al.

[11] Patent Number: 4,711,322

[45] Date of Patent: Dec. 8, 1987

[54] ELEVATOR CAB

[75] Inventors: Karl B. Orndorff, Bonneauville Boro; Paul L. Baldwin, Franklin Township, Adams County, both of Pa.

[73] Assignee: Westinghouse Electric Corp., Pittsburgh, Pa.

[21] Appl. No.: 863,482

[22] Filed: May 15, 1986

[51] Int. Cl.[4] ..... B66B 11/02; E04B 5/52

[52] U.S. Cl. ..... 187/1 R; 248/317; 52/39; 52/484

[58] Field of Search ..... 187/1 R; 362/148, 150, 362/366; 52/28, 39, 484; 248/317, 327, 272.1, 272.2, 223.1, 220.4

[56] References Cited

U.S. PATENT DOCUMENTS

| | | | |
|---|---|---|---|
| 480744 | 8/1892 | Robb | 248/317 |
| 3,139,162 | 6/1964 | Spangenberg | 52/484 X |
| 3,295,284 | 1/1967 | Tschiesche | 52/484 X |
| 4,032,096 | 6/1977 | Perrault et al. | 248/224.4 X |
| 4,126,210 | 11/1978 | Martin | 187/1 R |
| 4,164,011 | 8/1979 | Sherwood | 362/148 |
| 4,406,108 | 9/1983 | Beck et al. | 52/39 X |
| 4,425,603 | 1/1984 | Courson | 362/222 |
| 4,635,756 | 1/1987 | Sherwood et al. | 187/1 R |

FOREIGN PATENT DOCUMENTS

| | | | |
|---|---|---|---|
| 30090 | 10/1919 | Netherlands | 52/39 |

*Primary Examiner*—Joseph J. Rolla
*Assistant Examiner*—Nils E. Pedersen
*Attorney, Agent, or Firm*—D. R. Lackey

[57] ABSTRACT

An elevator cab having a drop ceiling which includes a frame and hanger straps for supporting drop ceiling panels. The hanger straps have first ends pivotally attached to the frame, and they pivot from a low profile shipping position to an extended operating position. The second ends of the hanger straps, when in their operative positions, extend through first openings in the cab ceiling or canopy, with the second ends having tab portions which are bent to secure the second ends of the hanger strap to the canopy. The tabs are bent by an installer from a position inside the elevator cab by use of a tool which is disposed through second openings in the canopy.

4 Claims, 6 Drawing Figures

ELEVATOR CAB

BACKGROUND OF THE INVENTION

1. Field of the Invention

The invention relates in general to elevator cabs, and more specifically to drop ceilings for elevator cabs.

2. Description of the Prior Art

An elevator cab usually includes a ceiling called a canopy, sidewalls which support the canopy, a light source adjacent to the canopy, and a decorative drop ceiling disposed below the light source. The drop ceiling includes a frame constructed of elongated right angle members, and one or more drop ceiling panels supported by the frame. It would be desirable to be able to quickly but reliably mount the drop ceiling frame in its operative position below the canopy, by an installer located inside the cab.

SUMMARY OF THE INVENTION

Briefly, the present invention is a new and improved elevator cab having a drop ceiling which includes a drop ceiling frame, hanger straps for securing the frame to the canopy, and one or more drop ceiling panels supported by the frame. The hanger straps are flat, elongated members having first and second ends, with their first ends being pivotally attached to the frame in the factory. The second ends of the hanger straps include a substantially T-shaped portion which defines lateral tabs, and first and second upstanding ear portions at the extreme lateral edges of the hanger strap. The hanger straps are pivotable from a relatively flat, low profile shipping position, which allows such pre-attachment without significantly increasing the size of the shipping package, to an extended operating position.

The canopy has lower and upper surfaces, and three different types or sizes of openings are provided in the canopy for each hanger strap, with these openings extending between the lower and upper surfaces of the canopy. The three different types of openings in the canopy for each hanger strap include a first opening in the form of an elongated slot for receiving the T-shaped portion of the second end of a hanger strap, after the hanger strap has been pivoted to its operating position. A second type of opening includes first and second similarly dimensioned small openings which are aligned with, but spaced from the ends of the elongated slot. These first and second small openings receive the first and second upstanding ear portions of the hanger strap, respectively, which align and positively locate the second end of the hanger strap, preventing it from shifting in the slot. A third type of opening includes first and second similar openings, which may be round, on opposite sides of the slot, and near the ends of the slot, for accepting a tool for bending the lateral tabs of the T-shaped portion of the hanger strap, to secure the second end of each hanger strap to the canopy. An installer, working from inside the elevator cab, can thus quickly install the stop ceiling frame.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
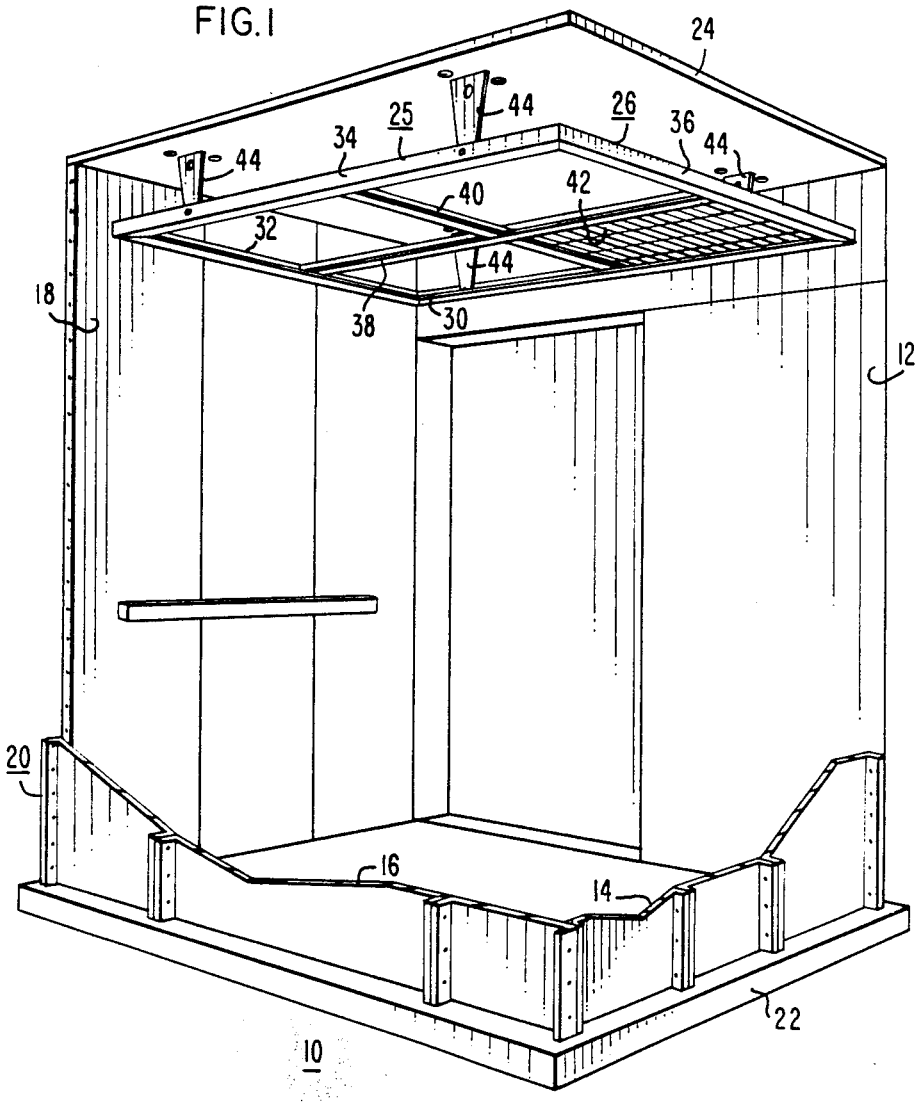
FIG. 1 is a perspective view of an elevator cab, shown partially cut away, in order to illustrate a drop ceiling which is attached to the cab canopy according to the teachings of the invention.

Referring now to the drawings, and to FIG. 1 in particular, there is shown an elevator cab 10 constructed according to the teachings of the invention. Cab 10 includes four upstanding sidewall portions 12, 14, 16 and 18, which are assembled to define an enclosure 20 which is supported by a platform 22. A canopy 24 is attached to the upper edges of the enclosure 20. Cab lighting fixtures (not shown) may be attached to the canopy 24, and a drop ceiling 26 is suspended from the canopy 24 to conceal the light source and to diffuse the light.

The drop ceiling 26 includes a frame 28 constructed of four elongated right angle members 30, 32, 34 and 36 whose ends are attached to form a rectangular or square configuration, as required to closely fit the cab configuration. The right angle of each elongated member faces inwardly to provide a shelf for supporting a drop panel, or panels. Cross pieces having a T-shaped cross-sectional configuration, such as members 38 and 40, may bisect the side of the frames to provide intermediate support for a plurality of drop panels, such as drop panel 42.

Frame 28 is secured to canopy 24 via a plurality of hanger straps 44, with four hanger straps being illustrated for purposes of example.

Figure 2:
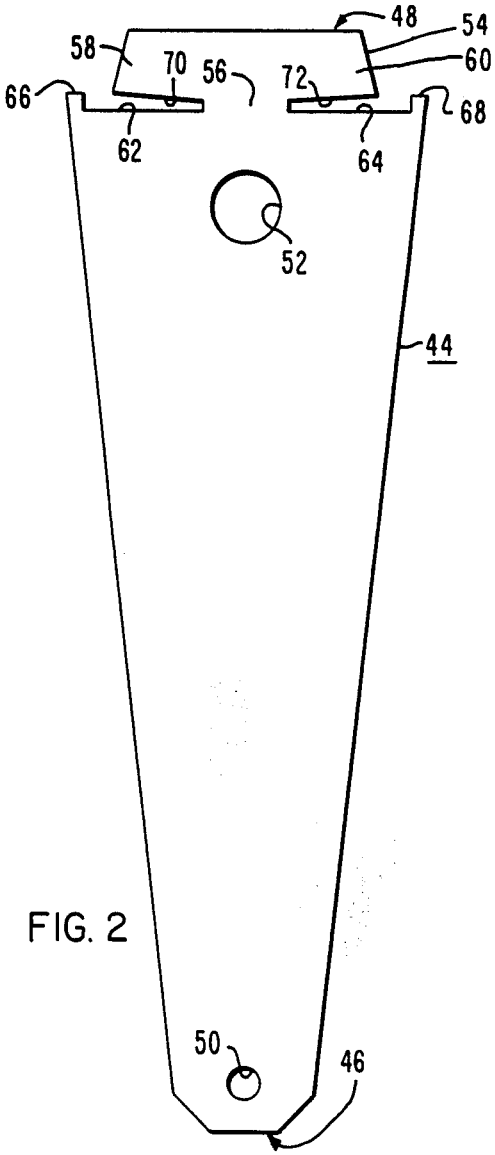
FIG. 2 is an elevational view of a hanger strap constructed according to the teachings of the invention.
Figure 3:
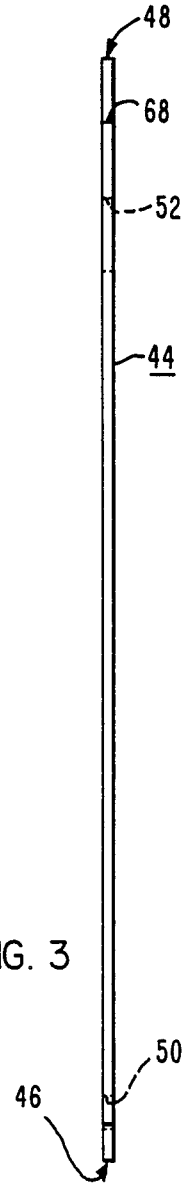
FIG. 3 is an edge view of the hanger strap shown in FIG. 2.

FIG. 2 is a side-elevational view of hanger strap 44, and FIG. 3 is an edge view. Hanger strap 44 is an elongated member formed from flat sheet metal, such as 0.060 inch thick steel. Hanger strap 44 has first and second ends 46 and 48, with openings 50 and 52 being provided near the first and second ends 46 and 48, respectively.

The first end 46 of hanger strap 44 is tapered in a narrowing direction towards the extreme end, and the corners are cut away or rounded to prevent interference with frame 26 as the hanger strap 44 is pivoted relative to frame 26, as will be hereinafter explained.

The second end 48 of hanger strap 48 terminates in a substantially T-shaped portion 54 having a relatively narrow stem 56 which supports first and second lateral tab portions 58 and 60. Hanger strap 44 has flat portions 62 and 64 which extend outwardly from the base of stem 56, and which terminate at first and second upstanding ear portions 66 and 68, respectively. It will be noted that the lower edges 70 and 72 of tab portions 58 and 60, respectively, are not parallel with flat portions 62 and 64, respectively, but start with a predetermined dimension at the step 56 which is slightly greater than the thickness dimension of canopy 24, and then edges 70 and 72 slope upwardly in a diverging relationship with the adjacent surfaces 62 and 64.

Figure 4:
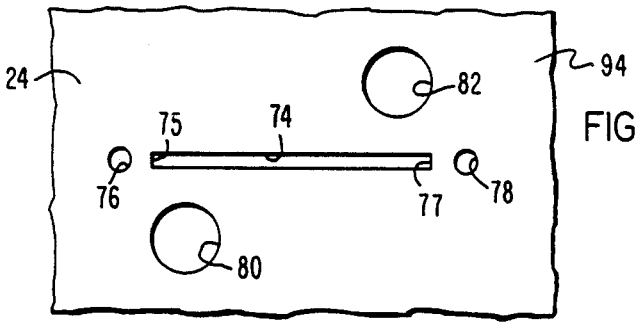
FIG. 4 is a fragmentary plan view of the elevator cab canopy, illustrating a pattern of openings which is associated with each hanger strap.

FIG. 4 is a fragmentary view of canopy 24, illustrating a pattern of openings which are provided therein for each hanger strap 44. A slot 74 is provided which is dimensioned to receive the T-shaped portion 54. First and second like-dimensioned round openings 76 and 78 are also provided in spaced relation relative to the ends 75 and 77 of slot 74, which openings are sized to snugly receive the first and second upstanding ear portions 66 and 68, respectively. First and second like round openings 80 and 82 are also provided on opposite sides of slot 74, with opening 80 being adjacent to end 75 of slot 74, and with opening 82 being adjacent to end 77 of slot 74. Openings 80 and 82 are sized to receive a tool, such as a screwdriver, for bending tab portions 58 and 60, respectively, as will be hereinafter described.

Figure 5:
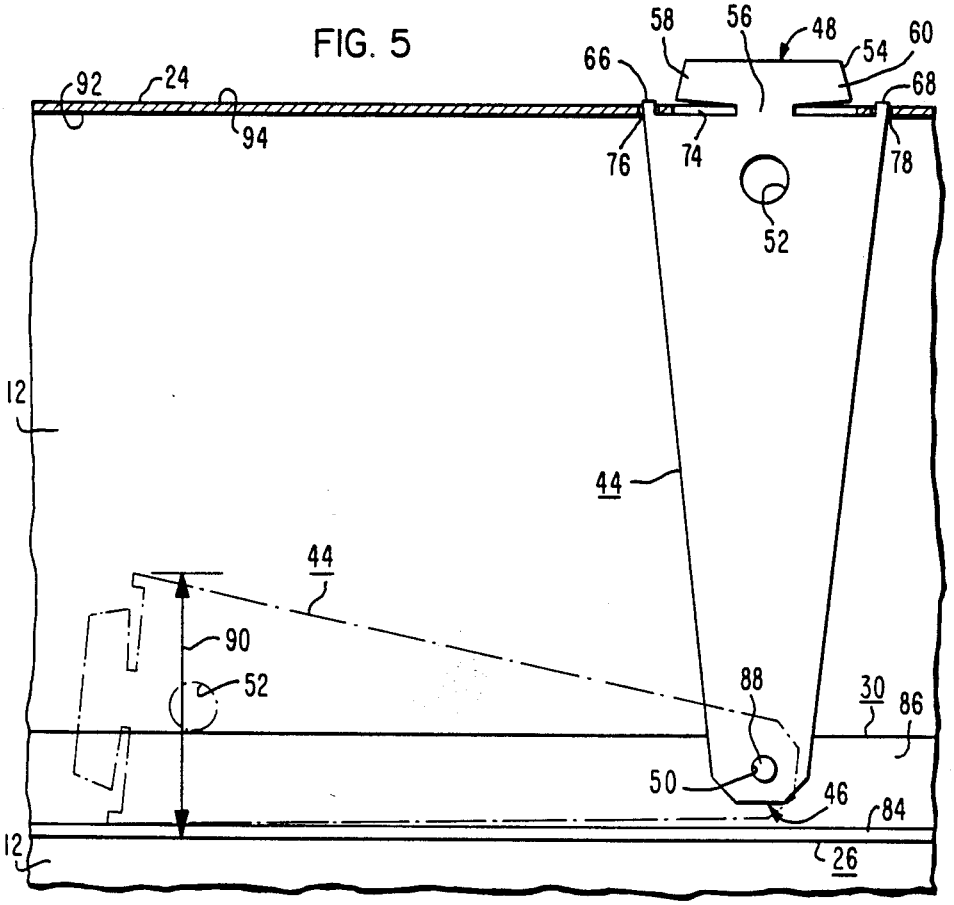
FIG. 5 is an elevational view of one of the hanger straps shown in FIG. 1, with the hanger strap interconnecting a drop ceiling frame to the cab canopy.

FIG. 5 is a fragmentary view of frame 26 and canopy 24, illustrating a hanger strap 44 supporting the elongated right angle member 30 of frame 26. Right angle member 30 includes first and second leg portions 84 and 86, respectively, with the first leg portion 84 being horizontally oriented to function as a shelf for supporting an edge of a drop ceiling panel member. The second leg portion 86 extends perpendicularly upward from the first leg portion 84.

The first end 46 of hanger strap 44 is pivotally fixed to the second leg portion 86 of right angle member 30, via a pivot pin 88 which extends through opening 50 in the hanger strap 44. Hanger strap 44 is pivotable between the relatively low profile position shown in phantom in FIG. 5, to the upstanding, operative position shown in solid in FIG. 5. Thus, hanger strap 44 may be factory assembled with frame 26, and shipped to a job site in a relatively small package, as the shipping height indicated by double-headed arrow 90 is several times less than the height of the frame and hanger strap assembly after the hanger straps have been pivoted to their upstanding operating positions. Opening 52 in hanger strap 44 provides a convenient way to engage the hanger strap 44 for pivoting it with a screwdriver, or similar tool, from one position to the other.

Figure 6:
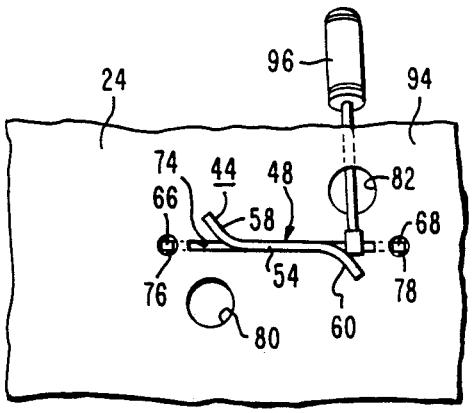
FIG. 6 is a plan view of the upper or outer surface of the cab canopy, illustrating how the hanger strap shown in FIG. 2 is secured to the canopy by an installer located inside the cab.

Canopy 24 has lower and upper surfaces 92 and 94, respectively, with FIG. 6 being a fragmentary plan view of upper surface 94. FIG. 6 is similar to FIG. 4, except illustrating the installation of a hanger strap 44. The installer pivots a hanger strap 44 from the shipping position shown in phantom in FIG. 5 to the operating position shown in solid in FIG. 5. The T-shaped portion 54 of the second end 48 of hanger strap 44 is inserted through slot 74 and the upstanding ear portions 66 and 68 are inserted into openings 76 and 78. The installer, operating from inside the cab 10, below surface 92 of canopy 24, then inserts a tool 96, such as a screwdriver, through opening 80 to bend tab 58, and through opening 82 to bend tab 60. The tapered clearance between the lower edges 70 and 72 of the tabs and the upper surface 94 of the canopy 24, enables the tabs 58 and 60 to be bent without interference with surface 94, resulting in more effective locking bends, i.e., the bend lines are more vertical, instead of merely bending the tabs over without swinging the bottom edges 70 and 72 away from the slot 74 and well over the upper surface 94 of the canopy 24. The locating ears 66 and 68 and cooperative openings 76 and 78 prevent stem 56 from shifting back and forth in slot 74. Thus, an installer, working entirely from inside elevator cab 10, can quickly and effectively suspend the drop ceiling frame 30 from the canopy 24.

We claim as our invention:

1. An elevator cab, comprising:

a canopy, sidewalls supporting said canopy, said canopy having lower and upper major, flat surfaces, and first openings which extend between said lower and upper flat surfaces, a frame for supporting drop ceiling panels, and hanger straps which support said frame below said canopy, each of said hanger straps being formed from a single flat sheet of metal, with each hanger strap having flat major sides disposed in parallel planes, to define an elongated, flat, single-piece metallic member having first and second ends, with the metal of each hanger strap extending continuously between said first and second ends, said second end of each hanger strap terminating in a substantially T-shaped portion having a relatively narrow stem which supports first and second lateral tab portions, means pivotally attaching the first end of each hanger strap to said frame, each of said hanger straps being pivotable about said frame-fastened first end, from a relatively flat, low profile shipping position, to an extended operating position, said first and second lateral tab portions at the second end of each hanger strap, with the hanger strap in its operative position, extending through one of said first openings in said canopy, with the metal which defines said first and second lateral tab portions being bent such that the first and second lateral tab portions are not in the parallel planes of the flat major sides of the associated hanger strap, said bent first and second lateral tab portions being adjacent to the upper flat surface of said canopy, to secure the second end of each hanger strap to said canopy.

2. An elevator cab, comprising:

a canopy, sidewalls supporting said canopy, said canopy having lower and upper major, flat surfaces, first openings which extend between said lower and upper flat surfaces, and second openings in the canopy, adjacent to the first openings, a frame for supporting drop ceiling panels, and hanger straps which support said frame below said canopy, each of said hanger straps having a first and pivotally fastened to said frame, and a second end, each of said hanger straps being pivotable from a relatively flat, low profile shipping position to an extended operating position, the second end of each hanger strap, with the hanger strap in its operative position, extending through one of said first openings in said canopy, with said second end being bent adjacent to the upper flat surface of said canopy to secure the second end of each hanger strap to said canopy, with the second end of each hanger strap being bendable via access through one of said second opening in the canopy, from a position below the lower surface of the canopy.

3. The elevator cab of claim 2 wherein the second end of each hanger strap includes a first portion configured to extend through one of the first openings in the canopy, with said first portion being substantially T-shaped to define bendable, laterally disposed tab portions.

4. The elevator cab of claim 2 wherein the second end of each hanger strap includes a first portion configured to extend through one of the first openings in the canopy, and upstanding ear portions laterally spaced from said first portion, and including third openings in the canopy, adjacent to the first openings, with said ear portions extending into said third openings.

* * * * *